US006071660A

United States Patent [19]

Black et al.

[11] Patent Number: 6,071,660

[45] Date of Patent: Jun. 6, 2000

[54] ELECTROPHOTOGRAPHIC PHOTOCONDUCTOR CONTAINING HIGH LEVELS OF POLYOLEFINS AS CHARGE TRANSPORT ADDITIVES

[75] Inventors: David Glenn Black; Gregory Walter Haggquist, both of Longmont; Dat Quoc Nguyen, Platteville, all of Colo.

[73] Assignee: Lexmark International, Inc., Lexington, Ky.

[21] Appl. No.: 09/267,188

[22] Filed: Mar. 12, 1999

[51] Int. Cl.[7] ..... G03G 5/087

[52] U.S. Cl. ..... 430/59.6; 430/58.8

[58] Field of Search ..... 430/59.6, 58.8

[56] References Cited

U.S. PATENT DOCUMENTS

| | | | |
|---|---|---|---|
| 4,784,928 | 11/1988 | Kan et al. | 430/58 |
| 5,021,309 | 6/1991 | Yu | 430/58 |
| 5,096,795 | 3/1992 | Yu | 430/59 |
| 5,385,797 | 1/1995 | Nagahara et al. | 430/67 |
| 5,418,098 | 5/1995 | Mayama et al. | 430/59.6 |
| 5,485,250 | 1/1996 | Kashimura et al. | 355/211 |
| 5,504,558 | 4/1996 | Ikezue | 355/211 |
| 5,610,690 | 3/1997 | Yoshihara et al. | 399/167 |
| 5,686,214 | 11/1997 | Yu | 430/58 |
| 5,714,248 | 2/1998 | Lewis | 428/325 |
| 5,725,983 | 3/1998 | Yu | 430/58 |
| 5,733,698 | 3/1998 | Lehman et al. | 430/66 |

*Primary Examiner*—John Goodrow

*Attorney, Agent, or Firm*—John A. Brady; Frost & Jacobs LLP

[57] ABSTRACT

A photoconductor for use in electrophotographic reproduction devices is disclosed. This photoconductor exhibits dramatically reduced end seal and paper area wear, as well as reduced positive electrical fatigue. The photoconductor of the present invention includes a low surface energy polyolefin wax, such as polyethylene or polypropylene, in relatively large particulate form having a mean particle diameter of from about 6 to about 12$\mu$, homogeneously dispersed in its charge transport layer.

11 Claims, No Drawings

ELECTROPHOTOGRAPHIC PHOTOCONDUCTOR CONTAINING HIGH LEVELS OF POLYOLEFINS AS CHARGE TRANSPORT ADDITIVES

TECHNICAL FIELD

The present invention relates to an improved photoconductor, used in electrophotographic reproduction devices, having a charge generating layer and a charge transport layer, which exhibits reduced positive electrical fatigue, as well as reduced end seal and paper area wear.

BACKGROUND OF THE INVENTION

The present invention is a layered electrophotographic photoconductor, i.e., a photoconductor having a metal ground plane member on which a charge generation layer and a charge transport layer are coated, in that order. Although these layers are generally separate from each other, they may be combined into a single layer which provides both charge generation and charge transport functions. Such a photoconductor may optionally include a barrier layer located between the metal ground plane member and the charge generation layer, and/or an adhesion-promoting layer located between the barrier layer (or ground plane member) and the charge generation layer and/or an overcoat layer on the top surface of the charge transport layer.

In electrophotography, a latent image is created on the surface of an insulating, photoconducting material by selectively exposing an area of the surface to light. A difference in electrostatic charge density is created between the areas on the surface exposed and those unexposed to the light. The latent electrostatic image is developed into a visible image by electrostatic toners containing pigment components and thermoplastic components. The toners, which may be liquids or powders, are selectively attracted to the photoconductor surface, either exposed or unexposed to light, depending upon the relative electrostatic charges on the photoconductor surface, development electrode, and the toner. The photoconductor may be either positively or negatively charged, and the toner system similarly may contain negatively or positively charged particles.

A sheet of paper or intermediate transfer medium is given an electrostatic charge opposite that of the toner and then passed close to the photoconductor surface, pulling the toner from the photoconductor surface onto the paper or intermediate medium still in the pattern of the image developed from the photoconductor surface. A set of fuser rollers melts and fixes the toner in the paper, subsequent to direct transfer or indirect transfer when an intermediate transfer medium is used, producing the printed image.

The electrostatic printing process, therefore, comprises an ongoing series of steps in which the photoconductor surface is charged and discharged as the printing takes place. It is important to keep the charge voltage and discharge voltage on the surface of the photoconductor relatively constant as different pages are printed to make sure that the quality of images produced is uniform (cycling stability). If the charge/discharge voltage is changed significantly each time the drum is cycled, i.e., if there is fatigue or other significant change in the photoconductor surface, the quality of the pages printed will not be uniform and will be unsatisfactory. Similarly, if the surface or other parts of the photoconductor undergo wear, particularly uneven wear, during the course of the printing process, the pages printed will not be uniform and the quality of the final product unsatisfactory.

It has now unexpectedly been found that addition to the charge transport layer of low surface energy polyolefin waxes having a mean particle diameter of from about 6–12$\mu$, reduces positive electrical fatigue and end seal and paper area wear in a photoconductor.

Organic and inorganic particles are known for use as charge transport dopants and for inclusion in various photoreceptor layers to improve wear. Particulates which have been disclosed for this use include low surface energy additives, such as polyolefins and fluorine-containing polymers (such as PTFE), as well as high surface energy additives, such as hydrophobic silica. Thus, U.S. Pat. No. 5,096,795, Yu, issued Mar. 17, 1992, teaches that the use of particulate materials in the charge transport layer of a photoconductor improves wear resistance and resistance to stress cracking while maintaining the good electrical properties of the photoconductor. Particles utilized include microcrystalline silica, polytetrafluoroethylene (PTFE), and micronized waxy polyethylene. Particles utilized in the charge transport layer have a diameter between about 0.1 and about 4.5$\mu$, with the average particle diameter being about 2.5$\mu$. It is taught that the particles are actually screened to remove larger particles such that the particles used fall within the defined particle size ranges.

U.S. Pat. No. 5,485,250, Kashimura, et al., issued Jan. 16, 1996, describes an electrophotographic imaging member having a surface layer comprising a binder resin and fluorine- or silicon-containing particles. The particles utilized include tetrafluoroethylene and polydimethyl siloxanes and have a diameter of from about 0.01 to about 5$\mu$, preferably from about 0.01 to about 0.35$\mu$. These devices are said to provide color images of improved quality.

U.S. Pat. No. 5,714,248, Lewis, issued Feb. 3, 1998, describes an electrophotographic imaging member that includes a coating comprising a resin, electrically conductive metal oxide particles and insulative particles (such as fumed silica, which is preferred, undoped zinc oxide and undoped titanium dioxide).

U.S. Pat. No. 5,733,698, Lehman, et al., issued Mar. 31, 1998, describes an electrophotographic photoreceptor, which is said to control beading of the toner carrier liquid on the photoreceptor surface, comprising an electroconductive substrate, a photoconductor layer, an interlayer, and an outer release layer. The surface of the release layer must have at least a minimum roughness that may be provided by incorporation of filler materials including polystyrene beads and acrylic particles (having a particle average diameter of from about 10 to about 50,000 nm).

U.S. Pat. No. 5,021,309, Yu, issued Jun. 4, 1991, describes the inclusion of particulate materials in the anti-curl layer of an electrophotographic imaging system to provide a reduced coefficient of surface friction and improved wear resistance without adverse effects on the optical or mechanical properties of the system. The particulate materials disclosed include fluorocarbon polymers, fatty amides, polyethylene waxes, polypropylene waxes and stearates, having a particle size diameter range of from about 0.1 to about 4.5$\mu$, with an average particle diameter of about 2.5$\mu$.

U.S. Pat. No. 5,686,214, Yu, issued Nov. 11, 1997, describes an electrophotographic imaging system that includes a ground-strip layer comprising a dispersion of conductive particles and solid organic particles in a film-forming binder. The organic particles disclosed include micronized waxy polyethylene particles having a particle size of from about 0.1 to about 5$\mu$.

U.S. Pat. No. 5,725,983, Yu, issued Mar. 10, 1998, describes the inclusion of a mixture of inorganic and organic particles in the charge transport layer, anti-curl layer or ground-strip layer of an electrophotographic photoreceptor. Useful organic particles disclosed include waxy polyethylene particles having a diameter in the range of from about 0.1 to about 4.5$\mu$, with an average particle diameter of about 2.5$\mu$.

U.S. Pat. No. 4,784,928, Karr, et al., issued Nov. 15, 1988, describes the inclusion of particles in the outer layer of an electrophotographic imaging element to enhance the release of toner from the element onto paper. Particles which are described as useful in this regard include tetrafluoroethylene and polyolefin waxes. There is no discussion of particle size, but they appear to be quite small; in one example, the particle size is 2$\mu$ and the entire layer formed is only 0.1$\mu$ thick.

U.S. Pat. No. 5,385,797, Nagahara, et al., issued Jan. 31, 1995, describes an electrophotographic imaging member that includes an outer protective layer comprising a binder resin and a particulate electroconductive material coated with a siloxane compound. The particles utilized in this layer are very small having a diameter of less than about 0.3$\mu$, preferably less than about 0.1$\mu$.

U.S. Pat. No. 5,504,558, Ikezue, issued Apr. 2, 1996, describes an electrophotographic imaging member which includes a fluorine-containing particulate resin in its surface layer. The particle sizes used are from about 0.01 to about 10$\mu$, preferably about 0.05 to about 2$\mu$. There is no suggestion to include a particulate resin in the charge transport layer. The essence of the invention is in the selection of specific binder resins for the surface layer and the photosensitive layer so as to provide good image quality with greater durability.

U.S. Pat. No. 5,610,690, Yoshihara, et al., issued Mar. 11, 1997, describes an electrophotographic imaging member having a lubricative resin powder in its surface layer and a spacer member in contact with that surface layer. This structure is said to provide good image quality without damaging the surface layer or causing it to separate from the photosensitive layer. Particulates disclosed as being useful include fluorine-containing resin powders (which are preferred), polyolefin resin powders, and silicon-containing resin powders.

As can be seen, none of these patents disclose photoconductor elements which include relatively large polyolefin waxy particles having a particle size of from about 6–12$\mu$ in their charge transport layer. In fact, the prior art suggests that particles in excess of 4.5$\mu$ create problems in a photoconductor context by scattering incident light or by harming the photoconductor electrical properties.

SUMMARY OF THE INVENTION

The present invention relates to an electrophotographic imaging member comprising a charge transport layer comprised of a thermoplastic film-forming binder, a charge transport molecule, and a homogeneous dispersion of a low-surface energy polyolefin wax (such as polyethylene or polypropylene) in particulate form having a mean particle diameter of from about 6 to about 12$\mu$. These electrophotographic imaging devices show dramatically reduced end seal and paper area wear, as well as reduced positive electrical fatigue in use.

More specifically, the present invention relates to an electrophotographic member comprising:

(a) a ground plane member;

(b) a charge-generating layer carried by said ground plane member comprising an effective amount of a photosensitive dye dispersed in a binder; and (c) a charge transport layer carried by said charge generating layer, comprising from about 25% to about 65% by weight of a charge transport molecule (preferably a hydrazone, such DEH), from about 35% to about 65% by weight of a thermoplatic film-forming binder resin, and from about 0.1% to about 10% by weight of a low surface energy polyolefin wax in particulate form having a mean particle diameter of from about 6 to about 12$\mu$ dispersed homogeneously in said charge transport layer.

As used herein, all percentages, ratios and parts are "by weight", unless otherwise specified.

DETAILED DESCRIPTION OF THE INVENTION

Photoconductors of the present invention find utility in electrophotographic reproduction devices, such as copiers and printers, and may be generally characterized as layered photoconductors wherein one layer (the charge-generating layer) absorbs light and, as a result, generates charge carriers, while a second layer (the charge transport layer) transports those charge carriers to the exposed surface of the photoconductor.

While these devices frequently have separate charge generation and charge transport layers, with the charge transport layer being overlaid on the charge generating layer, it is also possible to combine the charge generating and charge transport functions into a single layer in the photoconductor.

In the photoconductor structure, a substrate, which may be flexible (such as a flexible web or a belt) or inflexible (such as a drum), is uniformly coated with a thin layer of metallic aluminum. The aluminum layer functions as an electrical ground plane. In a preferred embodiment, the aluminum is anodized which turns the aluminum surface into a thicker aluminum oxide surface (having a thickness of from about 2 to about 12$\mu$, preferably from about 4 to about 7$\mu$). The ground plane member may be a metallic plate (made, for example, from aluminum or nickel), a metallic drum or foil, a plastic film on which, for example, aluminum, tin oxide or indium oxide is vacuum-evaporated, or a conductive substance-coated paper or plastic film or drum.

The aluminum layer is then coated with a thin, uniform thickness charge generating layer comprising a photosensitive dye material dispersed in a binder. Finally, the uniform thickness charge transport layer is coated onto the charge generating layer. The charge transport layer comprises a thermoplastic film-forming binder, a charge transport molecule, and a homogeneous dispersion of a low particulate surface energy polyolefin wax having a mean particle diameter of from about 6 to about 12$\mu$.

In the case of a single layer structure, the photosensitive layer comprises a charge generating material, a charge transport material, a binder resin, and the polyolefin wax particles.

The thickness of the various layers in the structure is important and is well-known to those skilled in the art. In an exemplary photoconductor, the ground plane layer has a thickness of from about 0.01 to about 0.07$\mu$; the charge generating layer has a thickness of from about 0.05 to about 5.0$\mu$, preferably from about 0.1 to about 2.0$\mu$, most preferably from about 0.1 to about 0.5$\mu$; and the charge transport layer has a thickness of from about 10 to about 25$\mu$, preferably from about 20 to about 25$\mu$. If a barrier layer is used between the ground plane and the charge generating layer, it has a thickness of from about 0.05 to about 2.0$\mu$. Where a single charge generating/charge transport layer is used, that layer generally has a thickness of from about 10 to about 25$\mu$.

In forming the charge generating layer utilized in the present invention, a fine dispersion of a small particle photosensitive dye material is formed in a binder material, and this dispersion is coated onto the ground plane member. This is generally done by preparing a dispersion containing the photosensitive dye, the binder and a solvent, coating the dispersion onto the ground plane member, and drying the coating.

Any organic photosensitive dye material known in the art to be useful in photo-conductors may be used in the present invention. Examples of such materials belong to any of the following classes:

(a) Polynuclear quinones, e.g., anthanthrones
(b) Quinacridones
(c) Naphthalene 1,4,5,8-tetracarboxylic acid-derived pigments, such as perinones
(d) Phthalocyanines and naphthalocyanines, e.g., $H_2$-phthalocyanine in X crystal form (see, for example, U.S. Pat. No. 3,357,989), metal phthalocyanines and napthalocyanines (including those having additional groups bonded to the central metal).
(e) Indigo and thioindigo dyes
(f) Benzothioxanthene derivatives
(g) Perylene 3,4,9,10-tetracarboxylic acid-derived pigments, including condensation products with amines (paralene diimides) and o-diamines (perylene bisimidazoles)
(h) Polyazo pigments, including bisazo-, trisazo-, and tetrakisazo-pigments
(i) Squarylium dyes
(j) Polymethine dyes
(k) Dyes containing quinazoline groups (see, for example, UK patent specification 1,416,602)
(l) Triarylmethane dyes
(m) Dyes containing 1,5-diamino-anthraquinone groups
(n) Thiapyrylium salts
(o) Azulenium salts; and
(p) Pyrrolo-pyrrole pigments Such materials are described in greater detail in U.S. Pat. No. 5,190,817, Terrell, et al., issued Mar. 2, 1993, incorporated herein by reference.

The preferred photosensitive dyes for use in the present invention are phthalocyanine dyes which are well known to those skilled in the art. Examples of such materials are taught in U.S. Pat. No. 3,816,118, Byrne, issued Jun. 11, 1974, incorporated herein by reference. Any suitable phthalocyanine may be used to prepare the charge-generating layer portion of the present invention. The phthalocyanine used may be in any suitable crystalline form. It may be unsubstituted either (or both) in the six-membered aromatic rings and at the nitrogens of the five-membered rings. Useful materials are described, and their synthesis given in Moser & Thomas, *Phthalocyanine Compounds*, Reinhold Publishing Company, 1963, incorporated herein by reference. Particularly preferred phthalocyanine materials are those in which the metal central in the structure is titanium (i.e., titanyl phthalocyanines) and metal-free phthalocyanines. The metal-free phthalocyanines are also particularly preferred, especially the X-crystalline form, metal-free phthalocyanines. Such materials are disclosed in U.S. Pat. No. 3,357,989, Byrne, et al., issued Dec. 12, 1967; U.S. Pat. No. 3,816,118, Byrne, issued Jun. 11, 1974; and U.S. Pat. No. 5,204,200, Kobata, et al., issued Apr. 20, 1993, all of which are incorporated herein by reference. The X-type non-metal phthalocyanine is represented by the formula:

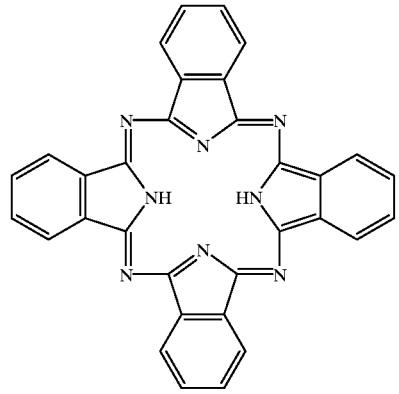

Such materials are available in an electrophotographic grade of very high purity, for example, under the tradename Progen-XPC from Zeneca Colours Company.

As the binder, a high molecular weight polymer having hydrophobic properties and good forming properties for an electrically insulating film is preferably used. These high molecular weight film-forming polymers include, for example, the following materials, but are not limited thereto: polycarbonates, polyesters, methacrylic resins, acrylic resins, polyvinyl chlorides, polyvinylidene chlorides, polystyrenes, polyvinylbutyrals, ester-carbonate copolymers, polyvinyl acetates, styrene-butadiene copolymers, vinylidine chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, and poly-N-vinylcarbazoles. These binders can be used in the form of a single resin or in a mixture of two or more resins.

Preferred materials include the bisphenol A and bisphenol A-bisphenol TMC copolymers described below, medium molecular weight polyvinyl chlorides, polyvinylbutyrals, ester-carbonate copolymers, and mixtures thereof. The polyvinyl chloride compounds useful as binders have an average molecular weight (weight average) of from about 25,000 to about 300,000, preferably from about 50,000 to about 125,000, most preferably about 80,000. The PVC material may contain a variety of substituents including chlorine, oxirane, acrylonitrile or butyral, although the preferred material is unsubstituted. Polyvinyl chloride materials useful in the present invention are well known to those skilled in the art. Examples of such materials are commercially available as GEON 110X426 from the GEON Company. Similar polyvinyl chlorides are also available from the Union Carbide Corporation.

Bisphenol A, having the formula given below, is a useful binder herein:

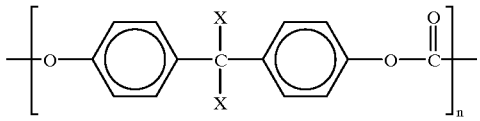

wherein each X is a $C_1$–$C_4$ alkyl and n is from about 20 to about 200.

The bisphenol binders referred to above are copolymers of bisphenol A and bisphenol TMC. This copolymer has the following structural formula:

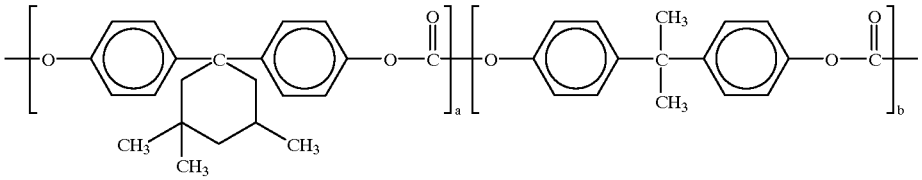

wherein a and b are such that the weight ratio of bisphenol A to bisphenol TMC is from about 30:70 to about 70:30, preferably from about 35:65 to about 65:35, most preferably from about 40:60 to about 60:40. The molecular weight (weight average) of the polymer is from about 10,000 to about 100,000, preferably from about 20,000 to about 50,000, most preferably from about 30,000 to about 40,000.

In forming the charge generating layer, a mixture of the photosensitive dye is formed in the binder material. The amount of photosensitive dye used is that amount which is effective to provide the charge generation function in the photoconductor. This mixture generally contains from about 10 parts to about 50 parts, preferably from about 10 parts to about 30 parts, most preferably about 20 parts of the photosensitive dye component, and from about 50 parts to about 90 parts, preferably from about 70 parts to about 90 parts, most preferably about 80 parts of the binder component.

The photosensitive dye/binder mixture is then mixed with a solvent or dispersing medium for further processing. The solvent selected should: (1) be a true solvent for high molecular weight polymers, (2) be non-reactive with all components, and (3) have low toxicity. Examples of dispersing media/solvents that may be utilized in the present invention, used either alone or in combination with preferred solvents, include hydrocarbons, such as hexane, benzene, toluene, and xylene; halogenated hydrocarbons, such as methylene chloride, methylene bromide, 1,2-dicholoroethane, 1,1,2-tricholoroethane, 1,1,1-tricholoroethane, 1,2-dichloropropane, chloroform, bromoform, and chlorobenzene; ketones, such as acetone, methylethyl ketone, and cyclohexanone; esters, such as ethyl acetate and butyl acetate; alcohols, such as methanol, ethanol, propanol, butanol, cyclohexanol, heptanol, ethylene glycol, methyl cellosolve, ethyl cellosolve, and cellosolve acetate, and derivatives thereof; ethers and acetals, such as tetrahydrofuran, 1,4-dioxane, furan and furfural; amines, such as pyridine, butylamine, diethylamine, ethylenediamine, and isopropanolamine; nitrogen compounds, including amides, such as N,N-dimethylformamide; fatty acids and phenols; and sulphur and phosphorous compounds, such as carbondisulfide and triethylphosphate. The preferred solvents for use in the present invention are methylene chloride, cyclohexanone and tetrahydrofuran (THF). The mixtures formed include from about 1% to about 50%, preferably from about 2% to about 10%, most preferably about 5% of the photosensitive dye/binder mixture, and from about 50% to about 99%, preferably from about 90% to about 98%, most preferably about 95% of the solvent/dispersing medium.

The entire mixture is then milled, using a conventional grinding mechanism, until the desired dye particle size is reached and is dispersed in the mixture. The organic pigment may be pulverized into fine particles using, for example, a ball mill, homogenizer, paint shaker, sandmill, ultrasonic disperser, attritor or sand grinder. The preferred device is a sandmill grinder. The photosensitive dye has a particle size (after grinding) ranging from sub-micron (e.g., about 0.01$\mu$) to about 5$\mu$, with a particle size of from about 0.05 to about 0.5$\mu$ being preferred. The mixture may then be "let down" or diluted with additional solvent to about 2–5 % solids, providing a viscosity appropriate for coating, for example, by dip coating.

The charge generating layer is then coated onto the ground plane member. The dispersion from which the charge generating layer is formed is coated onto the ground plane member using methods well known in the art including dip coating, spray coating, blade coating or roll coating, and is then dried. The preferred method for use in the present invention is dip coating. The thickness of the charge generating layer formed should preferably be from about 0.1 to about 2.0$\mu$, preferably around 0.5$\mu$. The thickness of the layer formed will depend upon the percent solids of the dispersion into which the ground plane member is dipped, as well as the time and temperature of the process. Once the ground plane member has been coated with the charge-generating layer, it is allowed to dry for a period of from about 0 to about 100 minutes, preferably from about 5 to about 60 minutes, more preferably from about 5 to about 30 minutes, at a temperature of from about 60° C. to about 160° C., preferably about 100° C.

The charge transport layer is then prepared and coated on the ground plane member so as to cover the charge-generating layer. The charge transport layer is formed from a solution containing a charge transport molecule in a thermoplastic film-forming binder having homogeneously dispersed therein the polyolefin wax particles, coating the solution onto the charge-generating layer and drying the coating.

In principle, a large class of known hole or electron transport molecules may be used in the present invention. Examples of such compounds include poly-N-vinylcarbazoles and derivatives, poly-τ-carbazolyl-glutamate and derivatives, pyrene-formaldehyde condensates and derivatives, polyvinylpyrene, polyvinylphenanthrene, oxazole derivatives, oxadiazole derivatives, imidazole derivatives, 9-(p-diethylamino-styryl) anthracene, 1,1-bis(4-dibenzylaminophenyl) propane, styrylanthracene, styryl-pyrazoline, arylamines, aryl-substituted butadienes, phenylhydrazones, and α-stilbene derivatives.

These charge transport molecules or systems of molecules are well-known in the art. A fundamental requirement of these low molecular weight organic compounds is that mobility (positive whole transfer through the layer) must be such that charge can transit the layer in a time that is short compared to the time between exposure and image development. Hole transport occurs through the transfer of charge from states associated with the donor/acceptor functionalities. This can be described as a donor/acceptor election transfer process. Oxidation potential measurements, as well as charge mobility measurements, have been used to evaluate the efficacy of charge transport molecules. Examples of such compounds are disclosed in U.S. Pat. No. 5,053,303, Sakaguchi, et al., issued Oct. 1, 1991. Preferred charge transport molecules are selected from hydrazones, butadienes, pyrazolines, and mixtures of those compounds. Hydrazones useful in the present invention are those compounds having the following general formula:

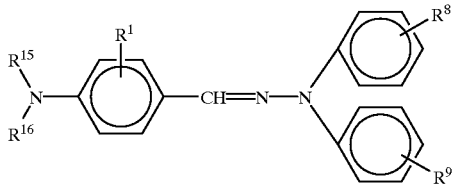

wherein $R^1$, $R^8$ and $R^9$, independently from each other, represent a hydrogen or a lower akyl, and $R^{15}$ and $R^{16}$, independently from each other, represent a lower alkyl or aryl.

Butadienes useful in the present invention are those compounds having the following general formula:

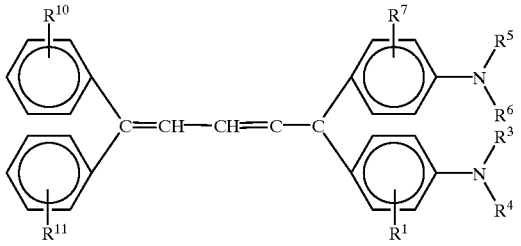

wherein $R^3$ and $R^4$, independently from each other, represent a lower akyl, and $R^1$, $R^5$, $R^6$, $R^{10}$ and $R^{11}$, independently from each other, represent hydrogen or a lower akyl.

The pyrazoline compounds useful in the present invention are those having the following structural formula:

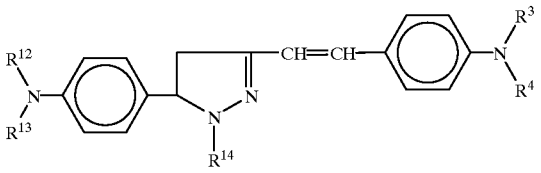

wherein $R^3$, $R^4$, $R^{12}$ and $R^{13}$, independently from each other, represent a lower alkyl, and $R^{14}$ represents a phenyl group which may contain one or more substituents.

Hydrazones are the preferred charge transport molecule for use in the present invention. The most preferred charge transport molecule is known as DEH, having the chemical name p-diethylaminobenzaldehyde-N,N-diphenylhydrazone. This compound has the following structural formula:

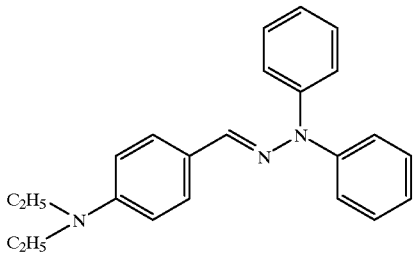

The binders used in the charge transport layer of the present invention are the binders described above which are used in the charge generating layer.

The charge transport layer also contains low surface energy polyolefin waxes in particulate form. The wax particles are homogeneously dispersed in the charge transport layer. These materials are well known in the art and include, for example, polyethylenes, polypropylenes, PTFE, and mixtures thereof. Polyethylenes and polypropylenes are particularly preferred. It is preferred that the polyolefin wax have a molecular weight (mean average) of from about 1,000 to about 25,000, preferably from about 1,200 to about 20,000. Specific examples of such materials useful in the present invention include polypropylenes having a molecular weight of about 1,200 and a mean particle diameter of from about 8 to about 11$\mu$ (commercially available as Micropro 200 from Micropowders, Inc.); polypropylenes having a molecular weight of about 1,200 and a mean particle diameter from about 6 to about 8$\mu$ (commercially available as Micropro 600 VF from Micropowders, Inc.); modified polyethylenes consisting of polyethylene having a molecular weight of about 2,000 and a mean particle diameter of from about 9 to about 11$\mu$, PTFE (MW=25,000), and erucamide (MW=700) (commercially available as Polysilk 14 from Micropowders, Inc.); and polypropylenes having a molecular weight of about 20,000 and a mean particle diameter of from about 8 to about 12$\mu$ (commercially available as Propylmatte 31 from Micropowders, Inc.). To be useful in the present invention, the polyolefin particles have a mean particle diameter of from about 6 to about 12$\mu$. The benefits of the present invention are lessened at particle sizes significantly below 6$\mu$. At particle sizes significantly above 12$\mu$, the electrical properties of the photoconductor are adversely affected.

The mixture of charge transport molecule(s), binder, and polyolefin wax particles, having a composition of from about 25% to about 65%, preferably from about 30% to about 50%, most preferably from about 35% to about 45% of the charge transport molecule(s); from about 35% to about 65%, preferably from about 50% to about 65%, most preferably from about 55% to about 65% of the binder; and from about 0.1% to about 10% preferably from about 1.5% to about 5% of the polyolefin wax particles, is then formulated. The amount of charge transport molecule utilized is that amount that is effective to perform the charge transport function in the photoconductor. The binders used, both in the charge transport and charge generating layers are used in an amount effective to perform their binder function. The mixture is formed such that the polyolefin wax particles are homogeneously dispersed throughout the mixture. This mixture is added to a solvent, such as those discussed above for use in forming the charge generation layer. Preferred solvents are THF, cyclohexanone, and methylene chloride. It is preferred that the solution contain from about 10% to about 40%, preferably about 25% of the binder/transport molecule/polyolefin wax mixture, and from about 60% to about 90%, preferably about 75% of the solvent. The charge transport layer is then coated onto the charge generating layer and the ground plane member using any of the conventional coating techniques discussed above. Dip coating is preferred. The thickness of the charge transport layer is generally from about 10 to about 25$\mu$, preferably from about 20 to about 25$\mu$. The percentage of solids in the solution, viscocity, the temperature of the solution, and the withdrawal speed control the thickness of the transport layer. The layer is usually heat dried for from about 10 to about 120 minutes, preferably about 30 to about 60 minutes at a temperature of from about 60° C. to about 160° C., preferably about 100° C. Once the transport layer is formed on the electrophotographic member, pre-treatment of the layer by either UV curing or thermal annealing is preferred in that it further reduces the rate of transport molecule leaching, especially at higher transport molecule concentrations.

In addition to the layers discussed above, an undercoat layer may be placed between the ground plane member (substrate) and the charge generating layer. This is essentially a primer layer which covers over any imperfections in the substrate layer, and improves the uniformity of the thin charge generation layer formed. Materials which may be used to form this undercoat layer include epoxy, polyamide and polyurethane. It is also possible to place an overcoat layer (i.e., a surface protecting layer) on top of the transport layer. This protects the charge transport layer from wear and abrasion during the printing process. Materials which may be used to form this overcoat layer include polyurethane, phenolic, polyamide and epoxy resins. These structures are well known to those skilled in the art.

The following examples illustrate the photoconductors of the present invention. These examples are intended to be illustrative and not limiting of the scope of the present invention.

EXAMPLE I

The materials which are utilized in the following examples are as follows:

Makrolon-5208 Polycarbonate (Bayer Corporation, Mn ~ 34000)

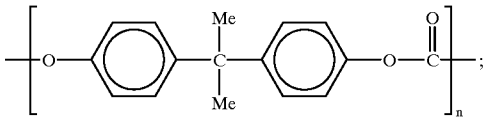

Titanylphthalocyanine (Type IV, SynTec Corporation)

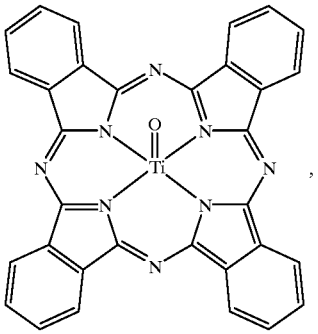

-continued

Polyvinylbutyral S-Lec-B (Sekisui Chemical Co.)-BX-55Z(Mn ~ 98000g/mol)

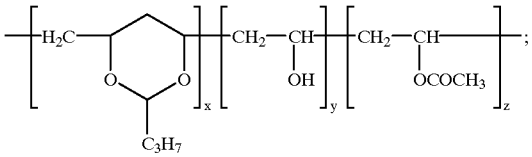

N, N′diphenyl-N, N′di(m-tolyl)-p-benzidine (TPD)

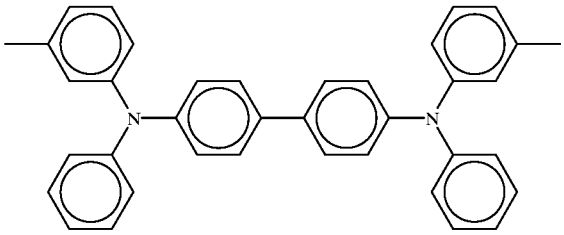

p-diethylaminobenzaldehyde-diphenyl hydrazone (DEH) (Kodak Corporation

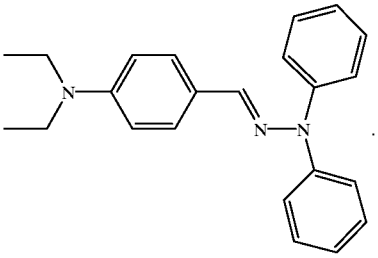

The type IV titanylphthalocyanine dispersion used in Examples I–III is prepared as follows: Cyclohexanone (400 g), methylethyl ketone (100.67 g), and BX-55Z (32 g) are added to a one quart metal can and shaken on a Red Devil paint shaker for one hour. After this pre-mix is completed, titanylphthalocyanine (68 g) is added and the can is shaken for an additional four hours. Cyclohexanone (25 g) and methyl-ethyl ketone (41 g) are then used to aid the transfer of the dispersion to a Netzsch mill (model LMJ05 from Netzsch Corporation). The material is milled for two hours and is let down with BX-55Z (51.11 g), cyclohexanone (63.59 g) and methylethyl ketone (4255.67 g), followed by an additional thirty minutes of milling. This procedure gives a dispersion of 3.0% solids, 45% titanylphthalocyanine, and a 10/90 cyclohexanone methylethyl ketone ratio.

A charge generating dispersion is prepared as described above, and dip-coated over anodized aluminum drums. The charge generation layer is then dried at 100° C. for fifteen minutes. The charge transport layer is coated over the charge generation layer and cured for an hour at 120° C.

The control charge transport solution is prepared as follows: THF (227.4 g), 1,4-dioxane (97.7 g), DC-200 (four drops), Savinyl yellow (Sandoz Corporation, 0.6 g), and DEH (33.3 g) are added to a one liter beaker. Makrolon 5208 (49.6 g) is added slowly to the yellow solution with vigorous stirring. The solution is 39.9% DEH (relative to total solids) and 20.4% total solids (relative to the total formulation). Formulations containing 2.5% polyolefin wax particles (relative to total solids) are prepared by removing 1.25 g Makrolon 5208 and adding 1.25 g polyolefin. The dispersion is stirred vigorously for 60 minutes. The polyolefin additives utilized are: Micropro 200 (8–11$\mu$ polypropylene); Micropro 600 VF (6–8$\mu$ polypropylene); and Polysilk 14 (9–11$\mu$ modified polyethylene). All of these polyolefins are commercially available from Micropowders, Inc.

Optical densities, coat weights, and initial voltage versus energy curves are measured in an electrostatic tester and the results are summarized in Table 1.

TABLE 1

Summary of coating properties and initial electrostatics for EXAMPLE I

| Additive | Optical Density | Coat weight mg/in$^2$ | $V_{0.2\mu J/cm^2}$ (−V) | Residual Voltage (−V)* |
|---|---|---|---|---|
| None (control) | 1.73 | 17.13 | 395 | 190 |
| MicroPro 200 | 1.74 | 17.36 | 418 | 224 |
| Micropro 600 VF | 1.73 | 16.66 | 413 | 207 |
| Polysilk 14 | 1.75 | 16.96 | 421 | 215 |

*1.1 $\mu J/cm^2$

These drums are then run to end of life (EOL) in Lexmark Optra SE printers (speed=32 pages per minute {ppm}). The fatigue data as measured in the printer is summarized in Table 2.

TABLE 2

Summary of fatigue data for EXAMPLE I.

| Additive | Prints | All Black Discharge Initial (−V)* | All Black Discharge (EOL) (−V)* | % Positive Fatigue | % Improvement |
|---|---|---|---|---|---|
| None (control) | 22,975 | 182 | 127 | 30.2 | — |
| Micropro 200 | 24,770 | 199 | 169 | 15.1 | 50.1 |
| Micropro 600 VF | 23,728 | 170 | 140 | 18.8 | 37.7 |
| Polysilk 14 | 21,724 | 191 | 154 | 19.4 | 35.9 |

*Voltage @ 0.75$\mu J$

Table 2 demonstrates the improved electrical stability (versus the control) imparted by the use of the polyolefin particulate additives of the present invention. Note that wear is generally not an issue with DEH-containing charge transport formulations.

EXAMPLE II

A charge generation dispersion is prepared as described in Example I, above, and dip-coated over anodized aluminum drums. The charge generation layer is then dried at 100° C. for 15 minutes. The charge transport layer is coated over the charge generation layer and cured for one hour at 120° C.

The control charge transport solution is prepared as follows: THF (227.4 g), 1,4-dioxane (97.7 g), DC-200 (Dow Corning Corporation, 4 drops), and TPD (21.4 g) are added to a one liter beaker. Makrolon 5208 (50.0 g) is added slowly to the opaque solution with vigorous stirring. The solution formed is 30% TPD (relative to total solids) and 18% total solids (relative to the total formulation). Formulations containing 1.0% (relative to the total solids) polyolefin particles are prepared by removing 0.5 g Makrolon 5208 and adding 0.5 g polyolefin additives. The dispersions are stirred vigorously for 60 minutes. The polyolefin additives utilized are: Polysilk 14 and Micropro 600 VF.

Optical densities, coat weights, and initial voltage versus energy curves are measured in an electrostatic tester and the results are summarized in Table 3.

TABLE 3

Summary of coating properties and initial electrostatics for EXAMPLE II.

| Additive | Optical Density | Coat weight mg/in$^2$ | $V_{0.2\mu J/cm^2}$ (−V) | Residual Voltage (−V)* |
|---|---|---|---|---|
| None (control) | 1.61 | 17.1 | 346 | 115 |
| Polysilk 14 | 1.6 | 17 | 362 | 134 |
| Micropro 600 VP | 1.61 | 17 | 357 | 131 |

*1.1 $\mu J/cm^2$

These drums were run to EOL in Lexmark Optra SE printers (speed=32 ppm). The fatigue (electrical data as measured in the printer) and wear data are summarized in Table 4.

TABLE 4

Summary of fatigue and wear data for EXAMPLE II

| Additive | Prints | All Black Discharge (Initial) (−V)* | All Black Discharge (EOL) (−V)* | % Positive Fatigue | % Improvement | Wear (Paper) | Wear (End seal) |
|---|---|---|---|---|---|---|---|
| None (control) | 24,156 | 134 | 118 | 11.9 | — | Yes | Yes |
| Polysilk 14 | 24,466 | 152 | 145 | 4.6 | 61.4 | Slight | Partial |
| Micro Pro 600 VF | 25,276 | 141 | 131 | 7.1 | 40.6 | Slight | Partial |

*Voltage @ 0.75 $\mu J$

Table 4 demonstrates the improved electrical stability (versus the control) imparted by the use of polyolefin wax charge transport additives. The use of 1% polyolefin also improves both end seal and paper area wear.

EXAMPLE III

A charge generation dispersion is prepared as described in Example I, above, and dip-coated over anodized aluminum drums. The charge generation layer is then dried at 100° C. for 15 minutes. The charge transport layer is coated over the charge generation layer and cured for one hour at 120° C.

The control charge transport solution is prepared as follows: THF (41.1 g), 1,1-dioxane (146.6 g), DC-200 (Dow Corning Corporation, 6 drops), and TPD (32.1 g) are added to a one liter beaker. Makrolon 5208 (75.0 g) is added slowly to the opaque solution with vigorous stirring. A formulation containing 2.5% (relative to total solids), polyolefin particles is prepared by removing 2.85 g Makrolon 5208 and adding 2.85 g Propylmatte 31 (8–12$\mu$, polypropylene). The dispersion is stirred vigorously for 60 minutes.

Optical densities, coat weights, and initial voltage versus energy curves as measured in an electrostatic tester are summarized in Table 5.

TABLE 5

Summary of coating properties and initial electrostatics for EXAMPLE III.

| Additive | Optical Density | Coat weight mg/in$^2$ | $V_{0.2\mu J/cm^2}$ (−V) | Residual Voltage (−V)* |
|---|---|---|---|---|
| None (control) | 1.63 | 16.7 | 336 | 110 |
| Propylmatte 31 | 1.64 | 16.3 | 330 | 103 |

*1.1 $\mu$J/cm$^2$

These drums are run to end of life in Lexmark Optra SE printers (speed=32 ppm). The fatigue (electrical data as measured in the printer) and wear data are summarized in Table 6.

TABLE 6

Summary of fatigue and wear data for EXAMPLE III

| Additive | Prints | All Black Discharge (Initial) (−V)* | All Black Discharge (EOL) (−V)* | % Positive Fatigue | % Improvement | Wear (Paper) | Wear (End seal) |
|---|---|---|---|---|---|---|---|
| None (control) | 24,666 | 162 | 112 | 30.9 | — | Yes | Yes |
| Propylmatte 31 | 22,987 | 126 | 108 | 14.3 | 53.7 | Slight | No |

*Voltage @ 0.75 $\mu$J

Table 6 demonstrates the improved electrical stability (versus the control) imparted by the use of polyolefin wax particle additives. The use of 2.5% polyolefin also improves both the end seal and paper area wear of the photoconductors tested.

EXAMPLE IV

Drums made using the procedures described in the preceding examples are cycled in an electrostatic printer to determine the extent of electrical fatigue independent of printer interactions. Table 9 shows the change (initial−1 k cycling) in voltage for the high energy discharge region (0.6–1.0 $\mu$J/cm$^2$) for formulations containing a TPD charge transport layer and a titanylphthalocyanine type IV charge generation layer.

TABLE 9

Summary of forced aging of titanylphthalocyanine

| Additive | Weight % | Voltage Change/−V |
|---|---|---|
| None (Control) | 0 | 15 |
| MicroPro 200 | 2.5 | −25 |
| MicroPro 200 | 5 | −42 |
| Polysilk 14 | 2.5 | −21 |
| Polysilk 14 | 5 | −41 |
| MicroPro 600 VF | 2.5 | −8 |

All of the additives overcompensate for the positive fatigue found in the set of control drums. This compensation can be varied by adjusting the loading of the additive on the electrophotoconductor drum.

What is claimed is:

1. An electrophotographic imaging member comprising a charge transport layer comprised of a thermoplastic film-forming binder, a charge transport molecule, and a low surface energy polyolefin wax in particulate form having a mean particle diameter of from about 6 to about 12$\mu$ homogeneously dispersed in said charge transport layer, wherein said polyolefin wax is selected from the group consisting of polypropylene having a molecular weight of about 1,200 and a mean particle diameter of from about 8 to about 11$\mu$ (Micropro 200), polypropylene having a molecular weight of about 1,200 and a mean particle diameter of from about 6 to about 8$\mu$ (Micropro 600VF), modified polyethylene having a molecular weight of about 2,000 and a mean particle diameter of from about 9 to about 11$\mu$ (Polysilk 14), polypropylene having a molecular weight of about 20,000 and a mean particle diameter of from about 8 to about 12$\mu$ (Propylmatte 31), and mixtures thereof.

2. An electrophotographic imaging member according to claim 1 wherein said polyolefin wax comprises from about 0.1% to about 10% by weight of the solids of said transport layer.

3. An electrophotographic imaging member comprising:

(a) a ground plane member;
(b) a charge generating layer carried by said ground plane member comprising an effective amount of a photosensitive dye dispersed in a binder; and
(c) a charge transport layer carried by said charge generating layer comprising from about 25% to about 65% by weight of a charge transport molecule; from about 35% to about 65% by weight of a thermoplastic binder resin; and from about 0.1% to about 10% by weight of a low surface energy polyolefin wax having a mean particle diameter of from about 6 to about 12$\mu$ homogeneously dispersed in said charge transport layer.

4. An electrophotographic imaging member according to claim 3 wherein said polyolefin wax has a molecular weight of from about 1,000 to about 25,000.

5. An electrophotographic imaging member according to claim 4 wherein said polyolefin wax is selected from the group consisting of polyethylenes, polypropylenes, PTFE, and mixtures thereof.

6. An electrophotographic imaging member according to claim 5 wherein said polyolefin wax is selected from the group consisting of polyethylenes, polypropylenes, and mixtures thereof.

7. An electrophotographic imaging member according to claim 6 wherein said polyolefin wax comprises about 0.1% to about 5% of the solids of said charge transport layer and is selected from the group consisting of polypropylene having a molecular weight of about 1,200 and a mean particle diameter of from about 8 to about 11$\mu$ (Micropro 200), polypropylene having a molecular weight of about 1,200 and a mean particle diameter of from about 6 to about 8$\mu$ (Micropro 600 VF), modified polyethylene having a molecular weight of about 2,000 and a mean particle diameter of about 9 to about 11$\mu$ (Polysilk 14); polypropylene having a molecular weight of about 20,000, and a mean particle diameter of from about 8 to about 12$\mu$ (Propylmatte 31); and mixtures thereof.

8. An electrophotographic imaging member according to claim 4 wherein the charge transport layer has a thickness of from about 10 to about 25$\mu$.

9. An electrophotographic imaging member according to claim 8 wherein said charge transport molecule has the formula:

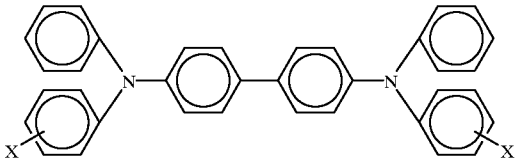

wherein X is selected from the group consisting of alkyl groups having from 1–4 carbon atoms and chlorine.

10. An electrophotographic imaging member according to claim 9 wherein said thermoplastic film-forming binder has the formula:

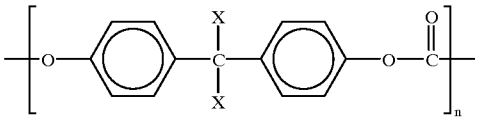

wherein X is an alkyl group having from 1 to 4 carbon atoms, and n is from about 20 to about 200.

11. An electrophotographic member according to claim 10 wherein said polyolefin wax comprises from about 0.1% to about 5% of the solids of said charge transport layer and is selected from the group consisting of polypropylene having a molecular weight of about 1,200 and a mean particle diameter of from about 8 to about 11$\mu$; polypropylene having a molecular weight of about 1,200 and a mean particle diameter of from about 6 to about 8$\mu$; modified polyethylene having a molecular weight of about 2,000 and a mean particle diameter of from about 9 to about 11$\mu$; polypropylene having a molecular weight of about 20,000, and a mean particle diameter of from about 8 to about 12$\mu$; and mixtures thereof.

* * * * *